US009830919B2

(12) United States Patent
Nagisetty et al.

(10) Patent No.: US 9,830,919 B2
(45) Date of Patent: Nov. 28, 2017

(54) ACOUSTIC SIGNAL CODING APPARATUS, ACOUSTIC SIGNAL DECODING APPARATUS, TERMINAL APPARATUS, BASE STATION APPARATUS, ACOUSTIC SIGNAL CODING METHOD, AND ACOUSTIC SIGNAL DECODING METHOD

(71) Applicant: Panasonic Intellectual Property Corporation of America, Torrance, CA (US)

(72) Inventors: Srikanth Nagisetty, Singapore (SG); Zongxian Liu, Singapore (SG); Hiroyuki Ehara, Kanagawa (JP)

(73) Assignee: PANASONIC INTELLECTUAL PROPERTY CORPORATION OF AMERICA, Torrance, CA (US)

( * ) Notice: Subject to any disclaimer, the term of this patent is extended or adjusted under 35 U.S.C. 154(b) by 0 days.

(21) Appl. No.: 15/063,529

(22) Filed: Mar. 8, 2016

(65) Prior Publication Data

US 2016/0189722 A1 Jun. 30, 2016

Related U.S. Application Data

(63) Continuation of application No. PCT/JP2014/003930, filed on Jul. 25, 2014.

(30) Foreign Application Priority Data

Oct. 4, 2013 (JP) ..... 2013-209593

(51) Int. Cl.
*G10L 19/038* (2013.01)
*G10L 19/02* (2013.01)

(52) U.S. Cl.
CPC ..... *G10L 19/038* (2013.01); *G10L 19/0204* (2013.01)

(58) Field of Classification Search
CPC ..... G10L 19/038; G10L 19/00; G10L 19/002; G10L 19/02; G10L 19/0204;
(Continued)

(56) References Cited

U.S. PATENT DOCUMENTS 8,924,208 B2 * 12/2014 Yamanashi ..... G10L 19/0208 704/230
2012/0146831 A1 * 6/2012 Eksler ..... G10L 19/038 341/200
(Continued)

FOREIGN PATENT DOCUMENTS

| | | |
|---|---|---|
| WO | 2011/086900 | 7/2011 |
| WO | 2011/132368 | 10/2011 |
| WO | 2012/005209 | 1/2012 |

OTHER PUBLICATIONS

International Search Report of PCT application No. PCT/JP2014/003930 dated Oct. 28, 2014.
(Continued)

*Primary Examiner* — Qi Han
(74) *Attorney, Agent, or Firm* — Greenblum & Bernstein, P.L.C.

(57) ABSTRACT

An acoustic signal coding apparatus includes a subband classifier that classifies subbands obtained by dividing a frequency-domain spectrum into a plurality of perceptually important first-category subbands and the other subbands referred to as second-category subbands according to at least one of measures in terms of energy and peak property, a subband peak-algebraic vector quantization (SBP-AVQ) vector generator that generates an SBP-AVQ vector by collecting a maximum peak from each first-category subband, outputs the generated SBP-AVQ vector, and outputs peak position information indicating the positions of the maximum peaks, a bit distributor that distributes bits for AVQ coding to the SBP-AVQ vector and the second-cat-
(Continued)

egory subband vector, and an AVQ coder that performs AVQ coding on the SBP-AVQ vector and the second-category subband vector.

13 Claims, 9 Drawing Sheets

(58) Field of Classification Search
CPC ... G10L 19/0208; G10L 19/032; G10L 19/22; G10L 19/24
USPC ..... 704/501, 500, 222, 206, 229, 230
See application file for complete search history.

(56) References Cited

U.S. PATENT DOCUMENTS

| | | | |
|---|---|---|---|
| 2012/0296640 | A1 | 11/2012 | Yamanashi et al. |
| 2013/0035943 | A1 | 2/2013 | Yamanashi et al. |
| 2013/0101028 | A1 | 4/2013 | Fukui et al. |

OTHER PUBLICATIONS

Stephane Ragot et al., "Low-complexity Multi-rate Lattice Vector Quantization With Application to Wideband TCX Speech Coding at 32 kbit/s", ICASSP 2004.
Recommendation ITU-T G.718 (Jun. 2008), Series G: Transmission Systems and Media, Digital Systems and Networks, Digital terminal equipments—Coding of voice and audio signals, Frame error robust narrow-band and wideband embedded variable bit-rate coding of speech and audio from 8-32 kbit/s.

* cited by examiner

ACOUSTIC SIGNAL CODING APPARATUS, ACOUSTIC SIGNAL DECODING APPARATUS, TERMINAL APPARATUS, BASE STATION APPARATUS, ACOUSTIC SIGNAL CODING METHOD, AND ACOUSTIC SIGNAL DECODING METHOD

BACKGROUND

1. Technical Field

The present disclosure relates to a technique of coding or decoding, using vector quantization, an acoustic signal such as a voice signal or a music sound signal.

2. Description of the Related Art

It is known to use vector quantization to code or decode an acoustic signal such as a voice signal or a music sound signal. A specific example of this method is algebraic vector quantization (AVQ) in which quantization is performed on pulses within a predetermined quantization bit rate as disclosed, for example, in Stephane Ragot, Bruno Bessette, Roch Lefebvre, "Low-complexity Multi-rate Lattice Vector Quantization With Application To Wideband TCX Speech Coding at 32 kbit/s", ICASSP 2004. In this technique, an input signal is converted by MDCT (Modified Discrete Cosine Transform) or the like to a frequency-domain signal (spectrum) in units of frames each including a predetermined number of samples, and the resultant signal is divided into a plurality of a subbands. In vector quantization employed in this technique, bits for quantization are assigned only to a part of spectrum of each subband, and "0" is assigned to the remaining part of the spectrum.

However, in the vector quantization, if a situation occurs in which a predetermined number of quantization bits is not sufficient to quantize all frequency components, an perceptually important spectral component may be lost, without being quantized, from some temporally successive frames, which may result in audible distortion. This phenomenon is known as a spectrum hole.

To handle the above situation, International Publication No. 2012/005209 discloses a coding method in which, first, a quantized normalized value is determined by quantizing a normalized value which is a representative value of a predetermined number of samples, and then a normalized value quantization index corresponding to the quantized normalized value is determined. In a case where when each sample value is subtracted by a value corresponding to the quantized normalized value, if the resultant subtracted value is positive and the sample value is also positive, then the subtracted value is employed as a value to be subjected to quantization corresponding to the sample, but if the subtracted value is positive and the sample value is negative, then the sing of the subtracted value is inverted and the resultant value is employed as the value to be subjected to quantization corresponding to the sample. The value to be subjected to quantization is then vector-quantized thereby determining the vector quantization index. The resultant vector quantization index is output. Using this method, major components including samples which would not be subjected to the vector quantization based on the AVQ method or the like are selected from all frequency components and the selected major components are intentionally quantized. This allows it to prevent an occurrence of a spectrum hole in the major component of the decoded signal.

International Publication No. 2011/086900 discloses a technique of correcting spectral data before it is converted into a lattice vector. For example the correction is performed such that values other than values of perceptually important samples are set to zero, thereby improving quality of a decoded signal. This technique can be performed at a low bit rate with a small amount of calculation.

Another improvement in the AVQ method may be found, for example, in International Publication No, 2011/132368. A description of other related techniques may be found, for example, in Recommendation ITU-T G.718, SERIES G: TRANSMISSION SYSTEMS AND MEDIA, DIGITAL SYSTEMS AND NETWORKS, Digital terminal equipments—Coding of voice and audio signals, Frame error robust narrow-band and wideband embedded variable bit-rate coding of speech and audio from 8-32 kbit/s.

SUMMARY

To achieve higher quality of a decoded acoustic signal, there is a need for a more efficient vector quantization method.

One non-limiting and exemplary embodiment provides an acoustic signal coding apparatus capable of obtaining a decoded acoustic signal with higher quality.

In one general aspect, the techniques disclosed here feature that an acoustic signal coding apparatus includes a time-to-frequency converter that converts an input signal to a spectrum in a frequency domain, a divider that divides the spectrum in the frequency domain into subbands, a subband classifier that classifies the subbands into a plurality of perceptually important first-category subbands and the other subbands referred to as second-category subbands according to measures in terms of energy and/or peak property; an SBP-AVQ (subband peak-algebraic vector quantization) vector generator that generates an SBP-AVQ vector by collecting a maximum peak from each first-category subband, outputs the generated SBP-AVQ vector, and outputs peak position information indicating the positions of the maximum peaks, a bit distributor that distributes bits for AVQ coding to the SBP-AVQ vector and the second-category subband vector, an AVQ coder that performs AVQ coding using the bits on the SBP-AVQ vector and the second-category subband, and a multiplexer that outputs a multiplexed signal in which the AVQ-coded signal and the peak position information are multiplexed. An example for generating SBP-AVQ is given below with reference to each embodiment.

The "energy" refers to energy possessed by a subband, and more specifically, for example, the energy may be an average energy of a subband. The energy may be an absolute value or a relative value with respect to another subband.

The "peak property" is a measure based on the strength, the density, or other properties of a shape of a peak included in a spectrum. More specifically, for example, a spectral flatness measure (SFM) may be employed as the peak property.

The "energy and/or the peak property" may be a measure in terms of at least one of the energy and the peak property.

Note that it does not necessarily need to perform evaluation in terms of "audible importance", but it is sufficient if perceptually important subbands are extracted using information on the energy, the peak property, or the like.

The "maximum peak" refers to the maximum peak in terms of the spectrum intensity.

The "peak position information" refers to information identifying a position of a peak in a first-category subband.

The "acoustic signal coding apparatus" refers to an apparatus that codes a signal such as a voice signal or a music sound signal.

The present disclosure makes it possible to reduce the probability of occurrence of a spectrum hole and achieve a decoded acoustic signal with higher quality.

It should be noted that general or specific embodiments may be implemented as a system, a method, an integrated circuit, a computer program, a storage medium, or any selective combination thereof.

Additional benefits and advantages of the disclosed embodiments will become apparent from the specification and drawings. The benefits and/or advantages may be individually obtained by the various embodiments and features of the specification and drawings, which need not all be provided in order to obtain one or more of such benefits and/or advantages.

DETAILED DESCRIPTION

Underlying Knowledge Forming Basis of the Present Disclosure

The inventors of the present application have paid their attention to the fact that human auditory sense is sensitive to a peak of spectrum, and have employed an approach in which spectral components other than perceptually important spectrum peaks are intentionally removed thereby achieving an increase in coding efficiency and thus preventing an occurrence of temporal discontinuity and an occurrence of a spectrum hole.

That is, in the acoustic signal coding apparatus and the like according to the present disclosure, spectrum is coded using the AVQ method such that, in assigning bits for encoding, high priority is given to perceptually important spectral components thereby making it possible to achieve a decoded acoustic signal with high quality.

First Embodiment

Figure 1:
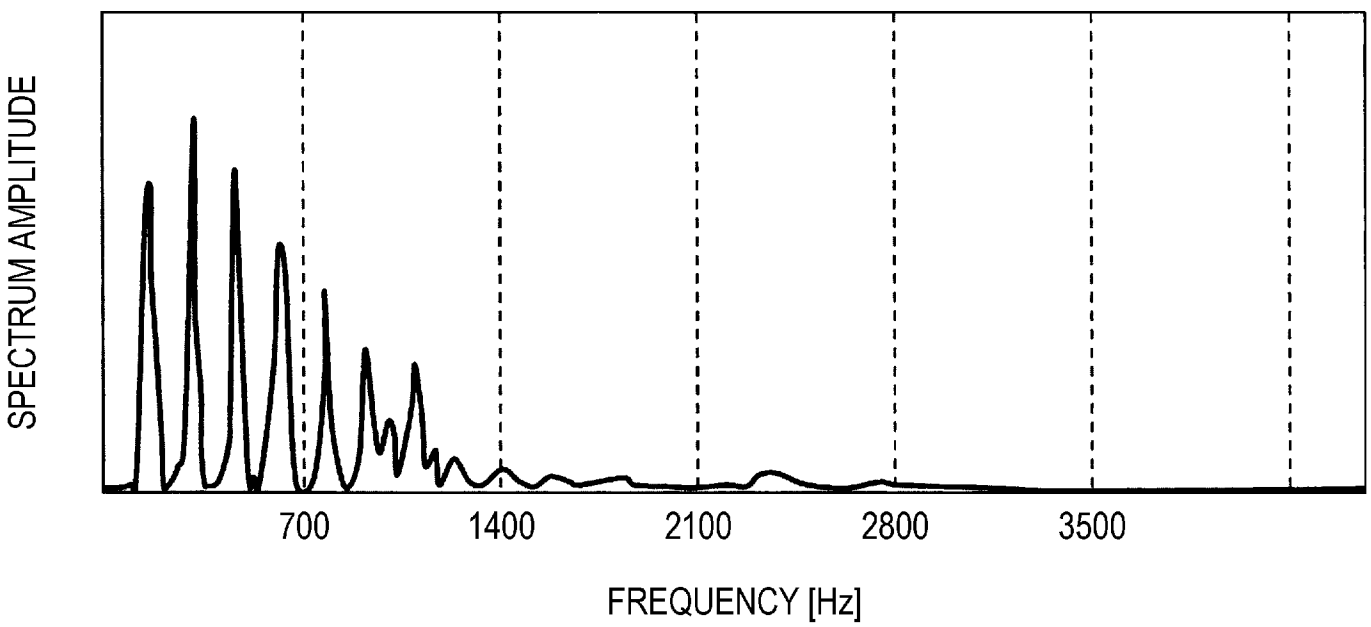
FIG. 1 is a schematic diagram of a spectrum of an acoustic signal to be processed according to the present disclosure.

First, FIG. 1 illustrates an example of a spectrum of an acoustic signal (a voice/music sound signal). A vertical axis represents a spectrum amplitude, and a horizontal axis represents a frequency. The spectrum includes characteristic peaks. However, in each subband with a width of about 700 Hz, there are only at most a few peaks. The peak amplitude decreases with frequency of peaks. In view of the above, the subbands are classified into subbands having many perceptually important spectral components and subbands having not many perceptually important spectral components, and the coding method is changed depending on the type of a subband of interest thereby increasing the coding efficiency.

Figure 2:
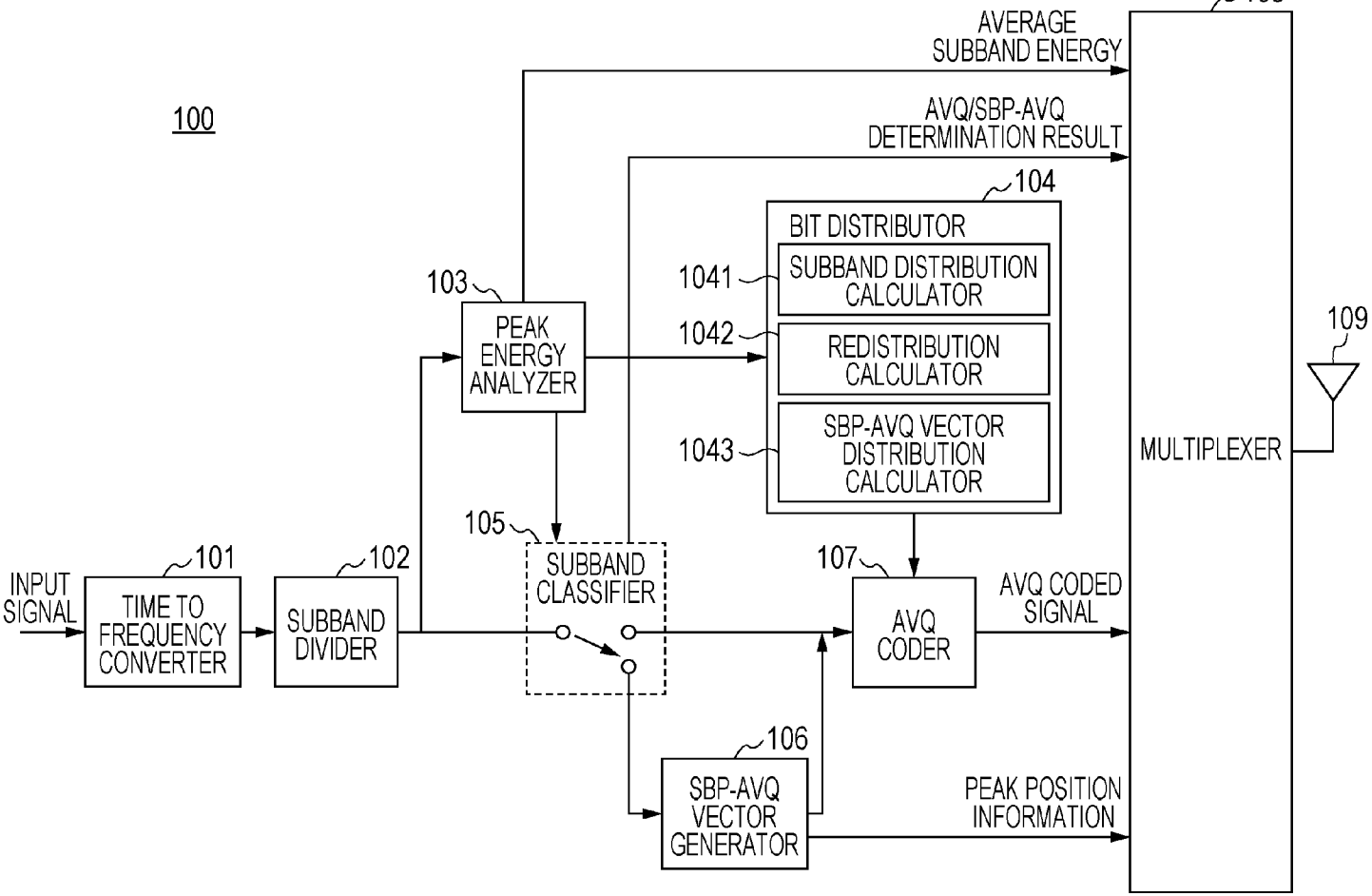
FIG. 2 is a diagram illustrating a configuration of an acoustic signal coding apparatus according to a first embodiment of the present disclosure.

Next, a configuration and an operation of an acoustic signal coding apparatus according to the first embodiment are described below referring to FIG. 2. The acoustic signal coding apparatus 100 includes a time-to-frequency converter 101, a subband divider 102, a peak/energy analyzer 103, a bit distributor 104, a subband classifier 105, an SBP-AVQ vector generator 106, an AVQ coder 107, and a multiplexer 108. Note that a completed terminal apparatus or a base station apparatus for use in communication can be obtained by combining the acoustic signal coding apparatus 100 and an antenna 109.

The time-to-frequency converter 101 converts a time-domain acoustic signal given as an input signal to a frequency-domain signal (spectrum). An example of the conversion method usable by the time-to-frequency converter 101 is a modified discrete cosine transform (MDCT). Alternatively, a discrete cosine transform (DOT) or other known time-to-frequency conversion methods may be used.

The subband divider 102 performs AVQ coding, based on RE8, that is, 8-dimensional Gosset lattice, on the frequency-domain signal (spectrum) converted by the time-to-frequency converter 101. To perform this, the frequency-domain signal is divided into subbands each including 8 samples. For example, in a case where sampling is performed at 16 kHz, a full band with a width of 8 kHz is divided into 12 subbands each having a bandwidth of about 700 Hz. Note that it is assumed by way of example that an 8-dimensional Gosset lattice is used, but alternatively, a Gosset lattice of another dimension may be used. Furthermore, although dividing is performed so as to obtain subbands with an equal bandwidth in the frequency domain, the bandwidth may be different between a low frequency range and a high frequency range.

The spectrum divided into the subbands is input to the peak/energy analyzer 103. The peak/energy analyzer 103 calculates, for example, the spectral flatness measure ($SFM_k$ which is the ratio of the geometric mean and the arithmetic mean of the spectrum amplitude (=geometric mean/arithmetic mean)) as the measure of the average energy ($E_k$) of each subband and the peak property of the spectrum of the subband, and the peak/energy analyzer 103 outputs the calculation result to the subband classifier 105 and the bit distributor 104.

The average energy $E_k$ of each subband is obtained according to a following formula, $$E_k = \frac{\sum_{i=1}^{N_k} S_k(i)^2}{N_k}$$

where k is a subband number (in the present example, in a range from 1 to 12), $N_k$ is the number of samples included in the subband (8 in the present example), and $S_k$ (i) is the input spectrum.

The spectral flatness measure ($SFM_k$) of each subband can be determined according to a following formula.

$$SFM_k = \sqrt[N_k]{\prod_{i=1}^{N_k} |S_k(i)|} \Big/ \frac{\sum_{i=1}^{N_k} |S_k(i)|}{N_k}$$

where k is a subband number (in the present example, in a range from 1 to 12), $N_k$ is the number of samples included in the subband (8 in the present example), and $S_k(i)$ is the input spectrum.

Note that the SFM is merely an example, and other various measures may be employed to evaluate the peak property. For example, the difference between the peak energy and the peak energy of the subband may be employed. Alternatively, the peak property may be evaluated based on the total number of peaks equal to or greater than a predetermined threshold value.

SFM may be defined by a following formula.

$$SFM_k = \sqrt{\sum_{i=1}^{N_k} S_k(i)^2} \Big/ \prod_{i=1}^{N_k} |S_k(i)|$$

The bit distributor 104 includes a subband distribution calculator 1041, a redistribution calculator 1042, and an SBP-AVQ vector distribution calculator 1043. In the present embodiment, the redistribution calculator 1042 does not operate. An example in which the redistribution calculator 1042 operates is given below with reference to a third embodiment.

The subband distribution calculator 1041 calculates the minimum number of bits required for performing AVQ coding on the spectrum of the subband, and then, according to the analysis result provided by the peak/energy analyzer 103, the subband distribution calculator 1041 assigns as many bits as calculated above to each subband, from a set of bits assigned in advance for use in coding the spectrum of a frame, in descending order of the average energy until there are no more bits.

The number of bits needed in the AVQ coding can be calculated based on a code book used. For example, in AVQ coding using 8-dimensional Gosset lattice RE8, five code books are used in the ascending order of code words. To identify code words in the respective code books, 4, 8, 12, 16, and 20 bits are required. In addition, to specify a code book, 1, 2, 3, 4, and 5 bits are required to represent an index of a code book number. Thus, in total, 5, 10, 15, 20, or 25 bits are required depending on the code book used to perform AVQ coding on a subband of interest. Furthermore, an index of a code book number is added. For example, in a variable length code according to ITU-T recommendation G.718, 0 is used as a stop bit, and indexes of code book numbers are assigned such that 10 is assigned to a smallest code book, 110 to a next one, 1110 to a further next one, and so on. In G.718, the smallest code book has a size of 8 bits (a 4-bit code book is not used alone), and thus 10, 15, 20, and 25 bits are required to perform AVQ coding. Note that there is a code defined in a code book whose code book number has an index of 0. A quantized spectrum represented by such a code is 0 (that is, when a quantized spectrum represents a spectrum with an amplitude of 0, an output AVQ code includes only one bit of "0". In a case where the number of bits assigned to AVQ is known, it is not necessary to put a stop bit in a variable length code representing an index of a code book number. Therefore, in this case, the number of bits necessary in AVQ coding can be smaller by one than is required in the above-described case.

When a voice signal or a music sound signal is subjected to spectrum coding according to the present embodiment, the smallest code book described above cannot provide all code words necessary in spectrum coding. Therefore, a bit (9 bits including the bits assigned to AVQ) is assigned in order to use at least two code books, that is, the smallest code book and the next smallest code book.

Furthermore, in a case where 8-dimensional AVQ is used to quantize a subband with a bandwidth $SB_{BW}$, which is greater than 8 in dimension, as many bits as necessary for the bandwidth may be assigned, for example, as defined below.

In a following formula, $\log_2 (SB_{BW}/8)$ is the number of bits needed to specify a set of eight elements in an $SB_{BW}$-dimensional vector higher than 8 in dimension. For example, when $SB_{BW}$=16, 16-dimensional vectors are divided into a first set of 8-dimensional vectors and a second set of 8-dimensional vectors, and 1 bit is used to indicate which one is selected. Alternatively, the 16-dimensional vectors may be divided into a set of even-numbered elements and a set of odd-numbered elements, and 1 bit may be used to indicate which one is selected.

$$B = 5 \times AVQcbk_{index\ min} + \log_2\left(\frac{SB_{BW}}{8}\right) - 1$$

where $AVQcbk_{indexmin}$=2 which is a smallest one of code books used in AVQ, and $SB_{BW}$ is the subband bandwidth. The operation of the SBP-AVQ vector distribution calculator 1042 in the bit distributor 104 will be described later.

Figure 3:
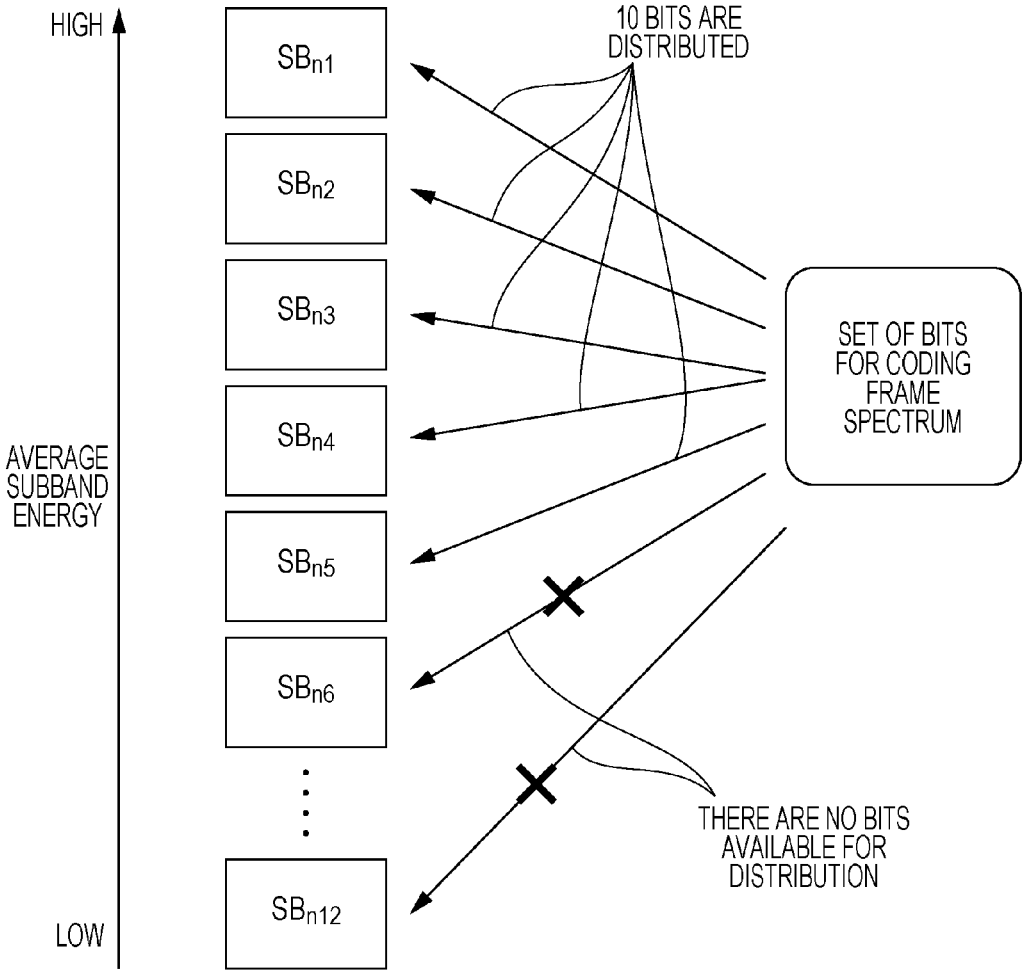
FIG. 3 is a diagram illustrating an operation of a bit distributor according to the first embodiment of the present disclosure.

By distributing bits in the above-described manner, subbands with low energy are excluded from those to be coded, and bits for coding are assigned preferentially to subbands with high energy. FIG. 3 illustrates an example of a manner in which bits are distributed.

The subband classifier 105 receives a result of analysis performed by the peak/energy analyzer 103, and classifies the subbands into an perceptually important subbands (first-category subbands) and the other subbands (second-category subbands). Furthermore, the subband classifier 105 outputs a classification result associated with each subband as an AVQ/SBP-AVQ determination result. Note that it does not necessarily need to use all items of the result of the analysis given by the peak/energy analyzer 103, but only one of the subband energy or the peak property may be used.

As many as 256 code words (that is, 256 spectrum shape types) can be specified by 10 bits distributed by the bit distributor 104. However, there is a possibility that 256 spectrum shapes are not sufficient to represent spectrum shapes of subbands with high peak property. Subbands having high average energy and being high in peak property are those which are perceptually important, and thus it is necessary to perform high precision coding on peaks of such subbands. Therefore, subbands are classified into subbands of the type described above (first-category subbands) and the other subbands (second-category subbands).

For example, the classification may be performed such that a subband having an average energy equal to or greater than the average energy of all subbands in a frame and having a SFM greater than 0.5 is classified as the first-category subband, and the other subbands are classified as the second-category subband.

Figure 4:
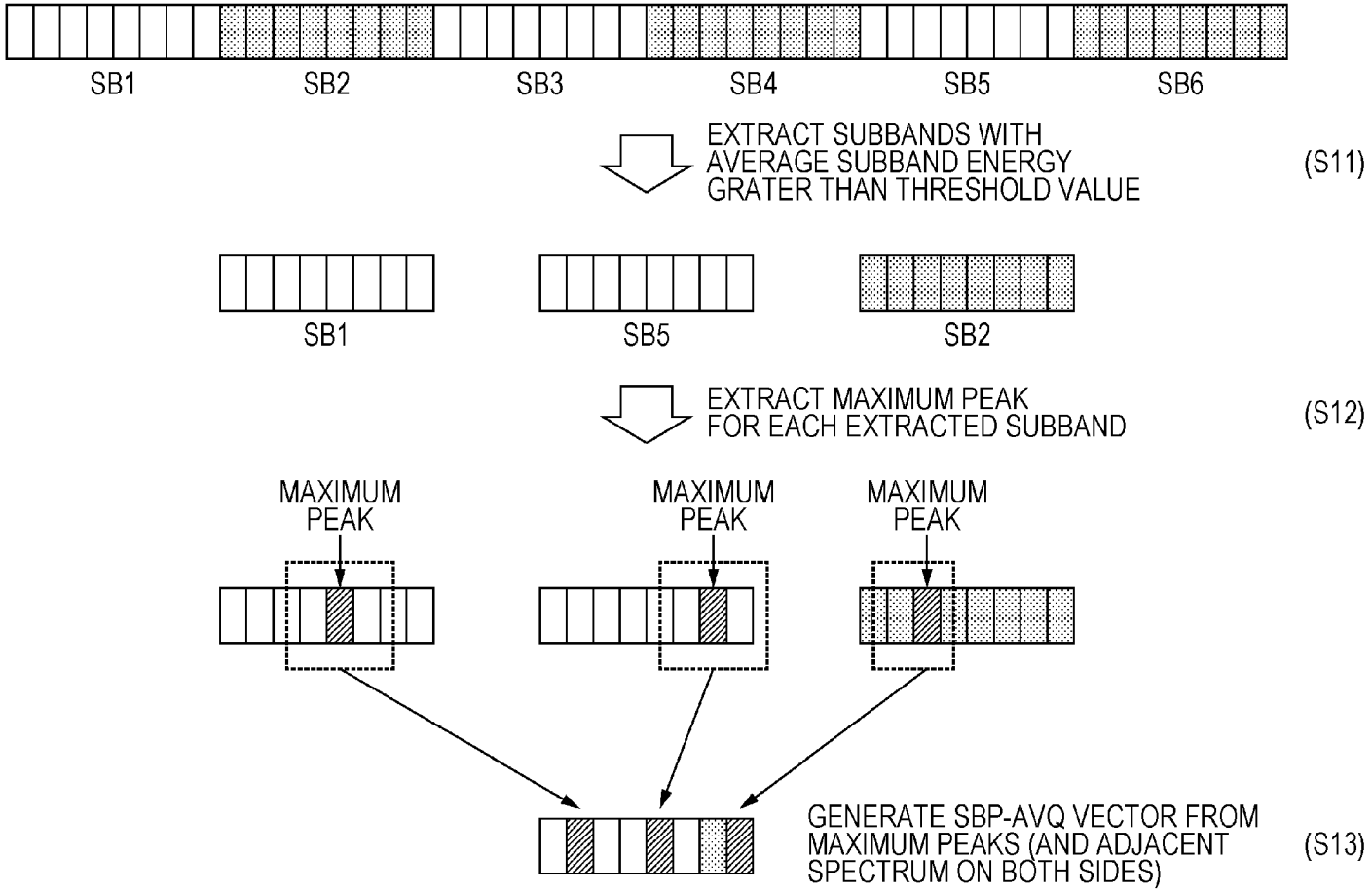
FIG. 4 is a diagram illustrating an operation of an SBP-AVQ vector generator according to the first embodiment of the present disclosure.

The SBP-AVQ vector generator 106 performs an operation described below on the subbands classified as the first-category subbands by the subband classifier 105. This operation performed by the SBP-AVQ vector generator 106 is described below with reference to FIG. 4.

The subband classifier 105 extracts vectors of the first-category subband in the manner described above (S11).

Next, a maximum peak is extracted from each subband in the first-category subbands (S12). In this process, peak position information representing a peak position with reference to a starting frequency of each subband in the first-category subbands is generated.

Maximum peaks are collected and a new vector (8-dimensional vector) is generated therefrom. Hereinafter, this vector will be referred to as an SBP-AVQ vector. Note that in the present embodiment, not only maximum peaks, but spectrum components adjacent to maximum peaks are also collected, and an SBP-AVQ vector is generated therefrom (S13). The procedure of this process is described in further detail below.

In a case where the number of vectors of the first-category subband is less than 8, spectrum components on both sides of the maximum peak are selected in descending order of energy and added to the SBP-AVQ vector. In a case where a maximum spectrum peak in a certain first-category subband is at an eighth sample location in the first-category subband, there is no spectrum component on the right side of this maximum peak. In this case, only a spectrum component on the left side of the maximum peak is added. Note that the reason why spectrum components on both side of a maximum spectrum peak are subjected to coding is to make it possible to more accurately reproduce an original shape of a spectrum peak in decoding. This makes it possible to accurately reproduce perceptually important peaks, and thus it becomes possible to obtain a decoded acoustic signal with a low reduction in sound quality. In a case where all spectrum components adjacent to maximum peaks cannot be placed in an 8-dimensional SBP-AVQ vector, spectrum components on both or one of sides of maximum peaks may be discarded. For example, in the case of SB2 shown in FIG. 4, only a 2-dimensional space remains in the SBP-AVQ vector, and thus a spectrum component on the right side of a maximum peak is discarded and only a spectrum component on the left side is put in the SBP-AVQ vector.

Note that only maximum peaks may be collected and an SBP-AVQ vector may be generated therefrom. In this case, it is allowed for the SBP-AVQ vector to include a greater number of peaks, which results in a reduction in probability that an perceptually important peak is missed.

Alternatively, a maximum peak and a sub-peak, that is, a next maximum peak may be extracted from each first-category subband, and an SBP-AVQ vector may be generated. This makes it possible to preserve a feature of a peak distribution of each subband, and thus it becomes possible to achieve a decoded acoustic signal with less degradation in sound quality. In this case, it may be preferable to generate peak position information so as to include a sub-peak position in addition to a maximum peak position.

Next, an operation of the SBP-AVQ vector distribution calculator 1043 in the bit distributor 104 will be described below.

Because the vector of the first-category subband is reconstructed as the SBP-AVQ vector by collecting maximum peaks as described above, it is necessary to calculate the number of newly assigned bits according to a procedure described below.

First, the total number Sum of encoded bits assigned to a vector of the first-category subband.

Next, for a maximum spectrum peak extracted from each first-category subband, a position of a starting frequency point of the subband is coded separately for each subband, the number of bits used for the coding is subtracted from Sum, and a result is employed as a new value of Sum. Spectrum peak position information of each first-category subband is coded sequentially unless Sum becomes lower than the minimum number of bits necessary to perform AVQ coding, that is, 10 bits. Sum obtained finally in the above-described manner is assigned to the SBP-AVQ vector.

To the AVQ coder 107, the SBP-AVQ vector generated by reconstructing the first-category subband and a vector of the second-category subband are input. The SBP-AVQ vector is then subjected to the AVQ coding using as many bits as the number of bits (equal to the final value of Sum) calculated by the SBP-AVQ vector distribution calculator 1042 in the bit distributor 104. Hereinafter, AVQ performed in such a manner on an SBP-AVQ is referred to as SBP-AVQ. For second-category subband vectors, AVQ coding is performed using bits calculated by the subband distribution calculator 1041 in the bit distributor 104 (hereinafter referred to as AVQ).

In the SBP-AVQ, only the maximum peak and adjacent spectrum components on both sides thereof in the spectrum of the first-category subband are subjected to the coding but other components in the spectrum are not subjected to the coding (that is, they are regarded as being zero). However, as many bits as the final value of Sum are assigned to coding of the SBP-AVQ vector including, as elements, maximum peaks and adjacent spectrum components on both sides thereof, and thus it becomes possible to use a code book with a greater size, which makes it possible to more accurately encode amplitude values.

Note that the coded spectrum peak position is determined for each subband, and thus it is necessary to transmit information indicating the first-category subband to which the spectrum peak belongs to. However, this can be determined at a receiving side based on the AVQ/SBP-AVQ determination result, and thus coding is not necessarily needed.

The multiplexer 108 multiplexes the AVQ-coded signal output from the AVQ coder 107 and the peak position information output from the SBP-AVQ vector generator 106 thereby generating a multiplexed signal. Note that the average subband energy calculated by the peak/energy analyzer 103 and the AVQ/SBP-AVQ determination result given by the subband classifier 105 may also be multiplexed. Furthermore, an index (information) of a subband belonging to the first-category whose spectrum peak is reconstructed in the SBP-AVQ vector may also be multiplexed.

The multiplexed signal is then transmitted via the antenna 109 toward a terminal apparatus having an acoustic signal decoding apparatus.

Figure 5:
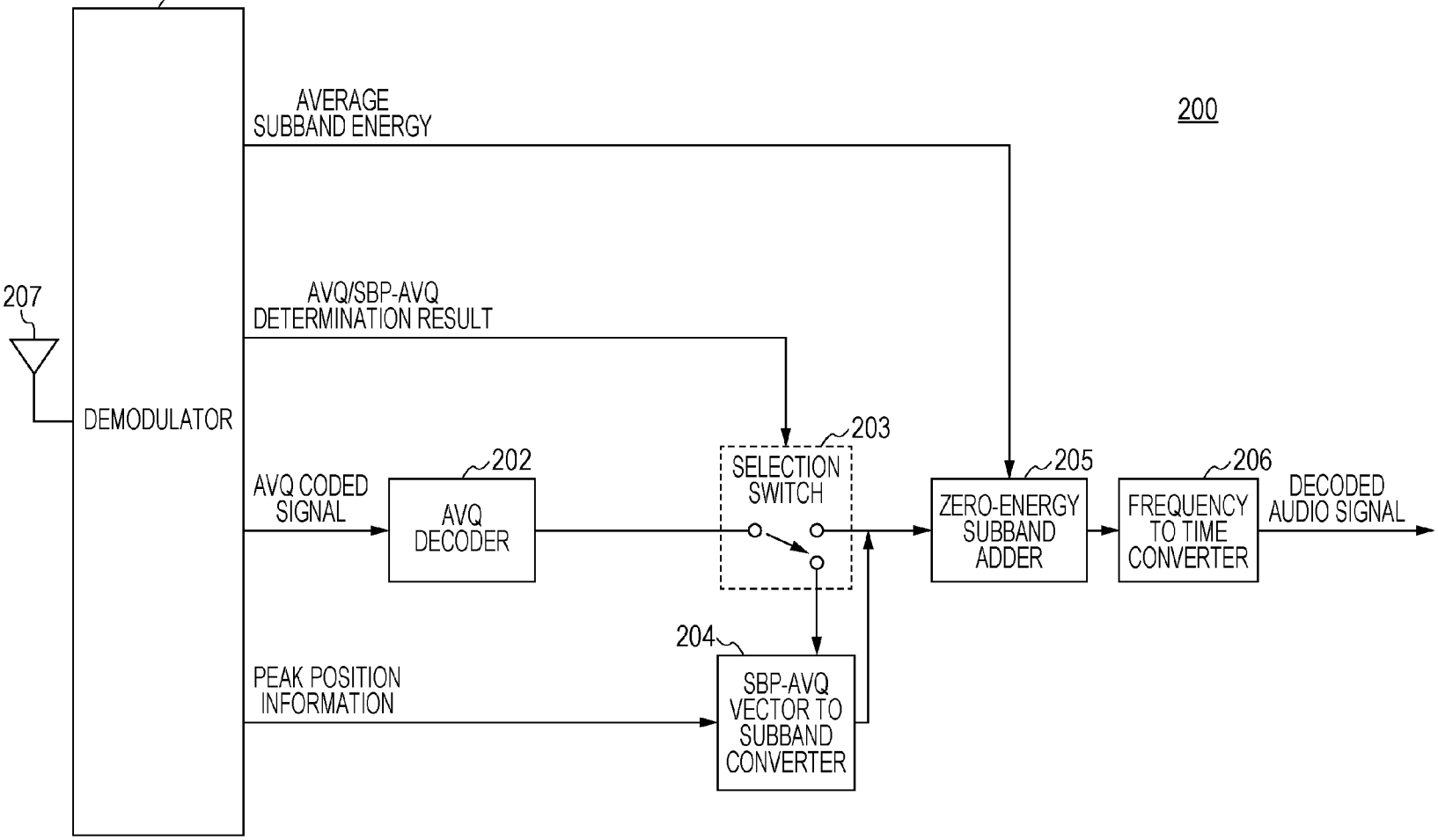
FIG. 5 is a diagram illustrating a configuration of an acoustic signal decoding apparatus according to the first embodiment of the present disclosure.

Next, a configuration and an operation of an acoustic signal decoding apparatus, which corresponds to the acoustic signal coding apparatus described above, according to the first embodiment of the present disclosure are described below with reference to FIG. 5. An acoustic signal decoding apparatus 200 includes a demultiplexer 201, an AVQ decoder 202, a selection switch 203, an SBP-AVQ vector-to-subband converter 204, a zero energy subband adder 205, and a frequency to time converter 206. Note that a complete terminal apparatus for use in communication can be obtained by combining the acoustic signal decoding apparatus 200 and an antenna 207.

The multiplexed signal transmitted from the acoustic signal coding apparatus 100 is received by the antenna 207 and is input to the demultiplexer 201.

The demultiplexer 201 demultiplexes the input multiplexed signal into an AVQ-coded signal and peak position information. In a case where the multiplexed signal also includes average subband energy and an AVQ/SBP-AVQ determination result, these are also demultiplexed.

The AVQ decoder 202 performs AVQ-decoding on the AVQ-coded signal thereby generating an AVQ-decoded signal including a set of 8-dimensional vectors. The AVQ-decoded signal includes an SBP-AVQ vector and a second-category decoded subband vector, which respectively correspond to an SBP-AVQ vector and a second-category subband vector coded by the acoustic signal coding apparatus 100.

According to a result of the AVQ/SBP-AVQ determination result, the selection switch 203 outputs the SBP-AVQ vector to the SBP-AVQ vector-to-subband converter 204, and outputs the second-category decoded subband vector directly to the zero energy subband adder 205.

The SBP-AVQ vector-to-subband converter 204 extracts, based on the received peak position information, a maximum spectrum peak and adjacent spectrum components on both sides thereof from the SBP-AVQ vector for each subband, and generates a plurality of first category decoded subbands whose elements are equal to 0 other than the elements extracted in the above-described manner. The SBP-AVQ vector-to-subband converter 204 then outputs the first-category decoded subband vector to the zero energy subband adder 205.

Based on the average energy information of the received subband, the zero energy subband adder 205 adds zero energy subbands such that subbands excluded, by the bit distributor 104 of the acoustic signal coding apparatus 100, from those subjected to the AVQ-coding are reconstructed as zero energy subbands and additionally inserted in the second category decoded subbands and the first category decoded subbands.

The result is output from the zero energy subband adder 205 to the frequency-to-time converter 206, which in turn converts it to a time-domain signal and outputs as a final decoded acoustic signal In this process, for example, IMDCT (Inverse MDCT) may be used as a method of the conversion.

According to the present embodiment, as described above, the acoustic signal coding apparatus codes only particularly important parts (peaks) in the first-category subbands which are perceptually important subbands thereby allowing it to assign many bits particularly to these parts. Thus it becomes possible for the acoustic signal decoding apparatus to achieve a decoded acoustic signal with suppressed spectrum holes.

Second Embodiment

Figure 6:
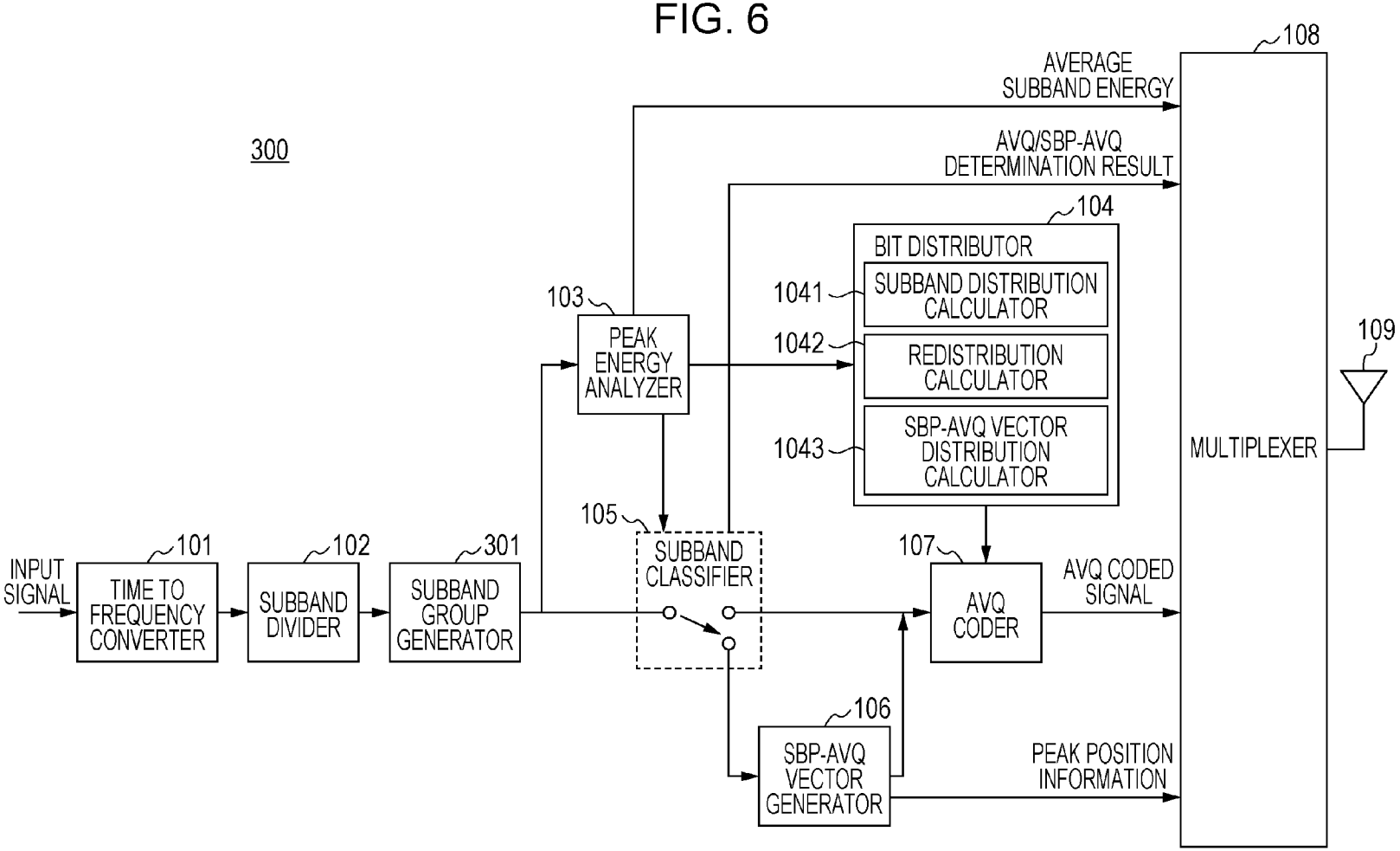
FIG. 6 is a diagram illustrating a configuration of an acoustic signal coding apparatus according to a second embodiment of the present disclosure.

Next, a configuration and an operation of an acoustic signal coding apparatus 300 according to a second embodiment are described below referring to FIG. 6. Blocks with similar configurations to those in FIG. 2 are denoted by similar reference numerals. The acoustic signal coding apparatus 300 according to the second embodiment is different from the acoustic signal coding apparatus 100 according to the first embodiment in that the acoustic signal coding apparatus 300 according to the second embodiment additionally includes a subband group generator 301.

In the present embodiment, subbands output from the subband divider 102 are grouped by the subband group generator 301. Herein a "subband group" is a set of one or more subbands. Grouping is performed into predetermined frequency bands, for example, a low frequency band, a middle frequency band, and a high frequency band, and the following process is performed separately for each subband group, for example, as described below.

The peak/energy analyzer 103 selects a subband with a large energy from a subband group and evaluates the peak property of the selected subband. In a case where one-half or more of the subbands in the subband group are evaluated as high in peak property, it is determined that this subband group has a high peak property. This determination result is coded by one bit for each group and is transmitted as an AVQ/SBP-AVQ determination result from the subband classifier 105 to the multiplexer. For the group determined as a high peak property group, all subbands included in this group are employed as first-category subbands and subjected to SBP-AVQ. That is, all subbands in the subband group are classified by the subband classifier 105 as first-category subbands and output to the SBP-AVQ vector generator 106. The SBP-AVQ vector generator 106 generates an SBP-AVQ vector for all subbands in the subband group, and the AVQ coder 107 performs AVQ coding by applying the bit distribution calculated by the SBP-AVQ vector distribution calculator in the bit distributor 104. All subbands included in any group other the group described above are processed as second-category subbands.

Alternatively, SBP-AVQ may be performed only on subbands evaluated as perceptually important based on the peak energy or the peak property of subbands in subband groups. In this case, AVQ/SBP-AVQ determination result or the like is transmitted for each subband.

Figure 7:
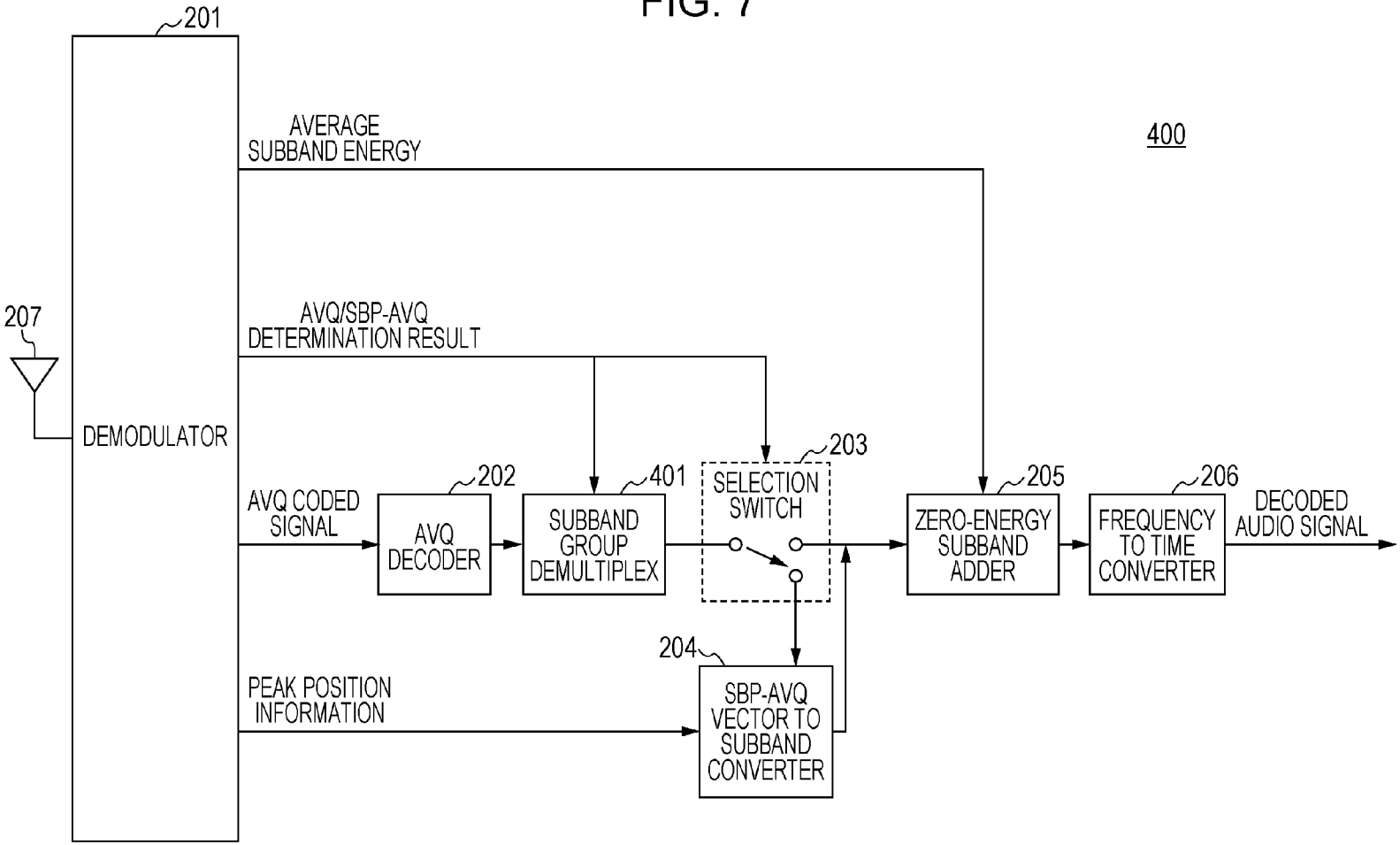
FIG. 7 is a diagram illustrating a configuration of an acoustic signal decoding apparatus according to the second embodiment of the present disclosure.

Next, a configuration and an operation of an acoustic signal decoding apparatus 400 according to the second embodiment are described below referring to FIG. 7. Blocks with similar configurations to those in FIG. 5 are denoted by similar reference numerals. The acoustic signal decoding apparatus 400 according to the present embodiment is different from the acoustic signal decoding apparatus 200 according to the first embodiment in that the acoustic signal decoding apparatus 400 according to the present embodiment additionally includes a subband group demultiplexer 401.

The AVQ decoder 202 performs AVQ decoding on the AVQ-coded signal thereby generating an AVQ-decoded signal including a set of 8-dimensional vectors. The subband group demultiplexer 401 divides the set of vectors into the low frequency band, the middle frequency band, and the high frequency band according to the AVQ/SBP-AVQ determination result. More specifically, according to the AVQ/SBP-AVQ determination result, the set of vectors is grouped into the low/middle/high subband groups such that in the case of AVQ, as many as predetermined number of second category decoded subbands are grouped, while in the case of SBP-AVQ, one SBP-AVQ vector are grouped. The selection switch 203 switches the output according to the AVQ/SBP-AVQ determination result such that the SBP-AVQ vector is output to the SBP-AVQ vector-to-subband converter 204 while the subband group including second category decoded subbands is directly output to the zero energy subband adder 205. The process following this is performed in a similar manner to the first embodiment.

According to the first embodiment, as described below, the details of the processing are determined depending on the subband group, and thus it is possible to reduce the amount of calculation, and it is possible to reduce the total number of bits necessary to encode information such as the AVQ/SBP-AVQ determination result for the whole subband groups. Thus it is possible to use remaining bits in the AVQ coding, and thus it is possible to achieve a decoded signal with enhanced quality.

Third Embodiment

Next, a configuration and an operation of an acoustic signal coding apparatus according to a third embodiment are described below referring to FIG. 2. In the acoustic signal coding apparatus according to the third embodiment, the redistribution calculator 1042 of the bit distributor 104 shown in FIG. 2 is enabled. In the present embodiment, after distribution of bits to subbands is performed by the subband calculator 1041 in a similar manner to the first embodiment, bits are redistributed by the redistribution calculator 1042 from subbands with small energy to subbands with high energy. Thereafter, subbands (first-category subbands) are reconstructed as in the first embodiment, and the SBP-AVQ vector distribution calculator 1043 calculates bits to be distributed to an SBP-AVQ vector when it is generated.

That is, to achieve higher accuracy in coding maximum peaks (and adjacent spectrum components on both sides thereof) in subbands, bits are redistributed, between subbands to which bits have been distributed, from subbands with low energy to subbands with high energy, as described below.

First, subbands with low energy are excluded from those to be subjected to coding, and bits originally assigned to these subbands are employed as bits for redistribution ($R_e$). When the number of such bits ($eb_{act}$) reaches a predetermined value, the peak/energy analyzer 103 redistributes bits in units of a predetermined number of bits (k) in descending order of peak property such that k bits are redistributed to all subbands evaluated as being high in peak property by the subband classifier 105. In a case where there are still remaining bits in $R_e$, they are further redistributed in a similar manner until there is no more bits in $R_e$.

More specifically, for example, 5 bits are assigned as k bits described above. This ensures that one code book with a large size can be used in AVQ coding, which makes it possible to achieve higher accuracy in coding peaks.

Figure 8:
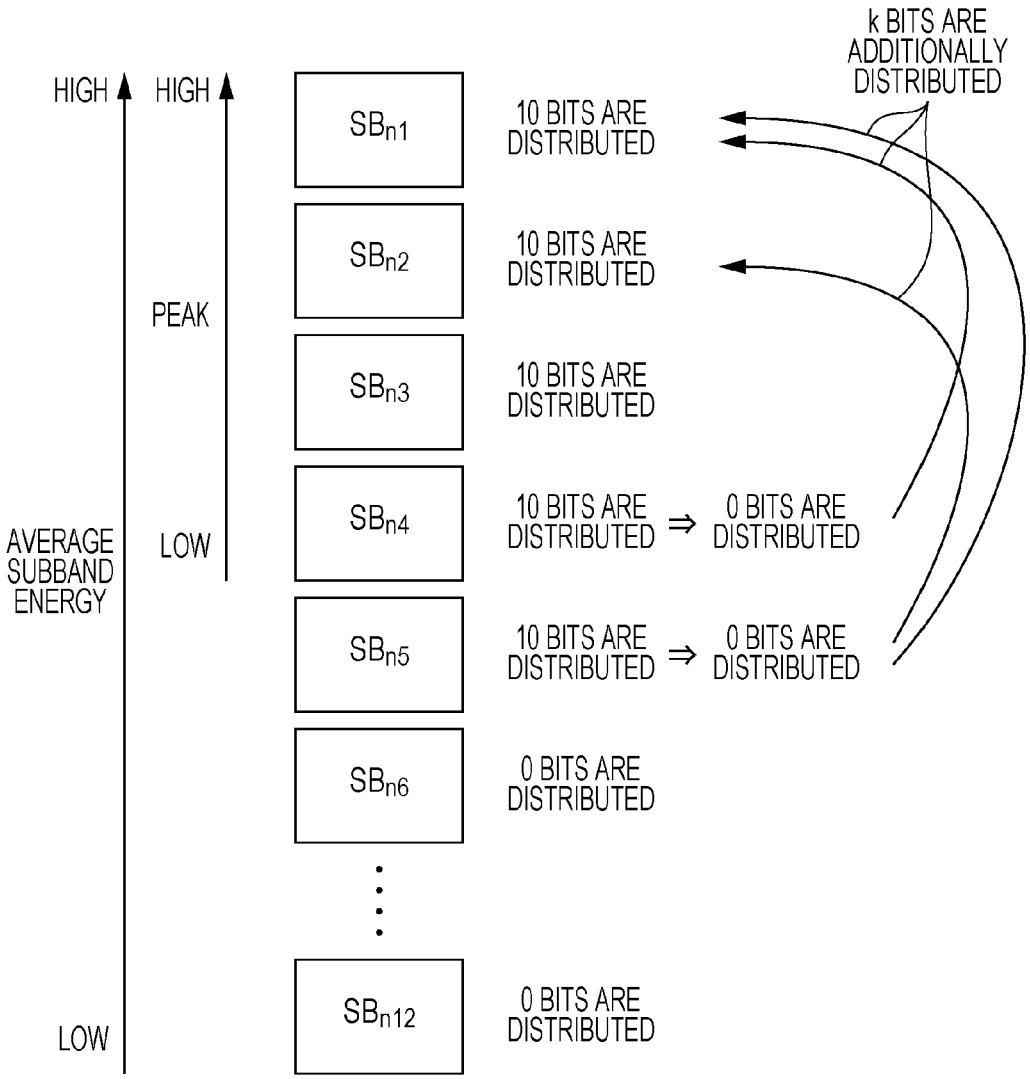
FIG. 8 is a diagram illustrating an operation of a bit distributor according to a third embodiment of the present disclosure.

FIG. 8 illustrates an example of a manner in which bits are redistributed.

Note that there can be many ways in terms of selecting subbands to which bits are redistributed, the redistribution order, and setting of $eb_{act}$. Some examples are described below as first, second and third setting methods. In these first, second, and third setting methods, subbands having energy and/or peak property lower than a predetermined threshold vale are selected from the second-category subbands and bits are redistributed from the selected subbands to first-category subband vectors. Herein, the "threshold value" may be a measure in terms of energy and/or peak property. For example, the measure may be the average energy of a subband, SFM, or a proper modification thereof or a processes value thereof. Note that the criterion used above to classify subbands into the first-category subbands and the second-category subbands may be directly used as the measure. In this case, bits distributed to the second-category subbands are redistributed to SBP-AVQ vectors.

First Setting Method

The peak/energy analyzer 103 extracts, from subbands with high peak property (for example SFM>0.8), those having particularly high peak property and specifies them as dominant subbands to which bits are to be redistributed in descending order of SFM and defines $eb_{act}$ by the following formula.

$$eb_{act}=k\times n_D$$

where $n_D$ is the number of dominant subbands. In a case where there are bits remaining after assigning bits to all subbands in a frame in the process described above, the remaining bits may be subtracted from the formula described above as shown below.

$$eb_{act}=k\times n_D-n_{rb}$$

where $n_{rb}$ is the number of remaining bits.

Second Setting Method

Figure 9:
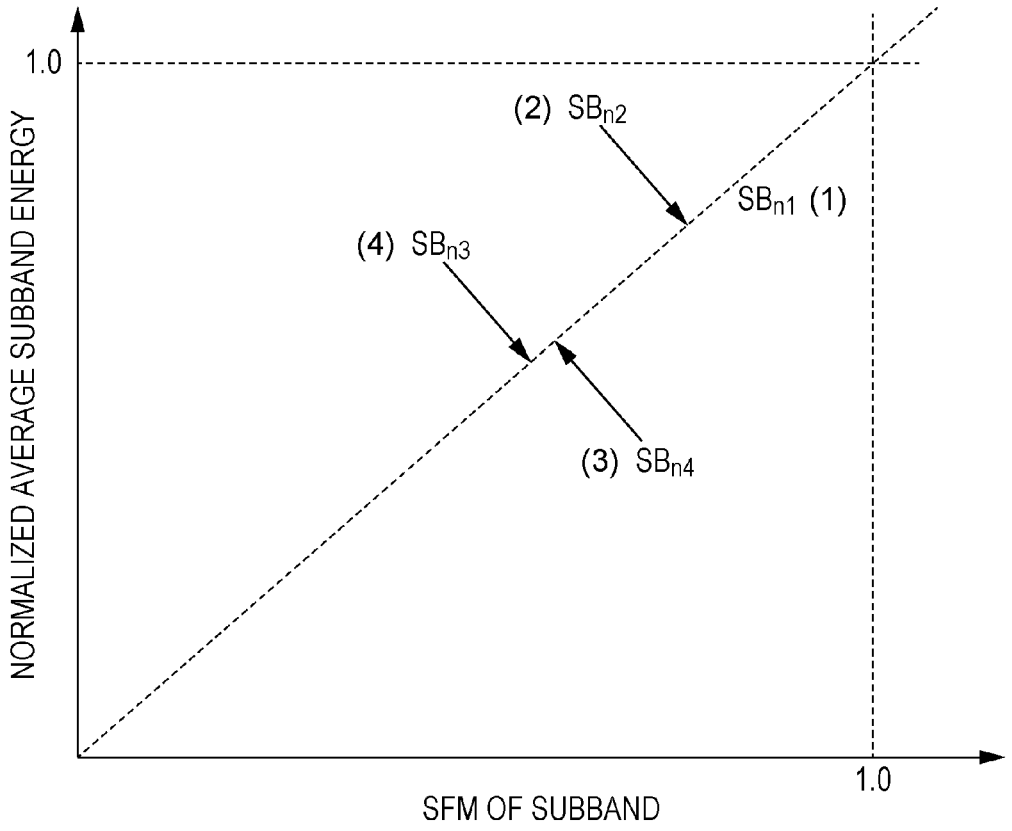
FIG. 9 is a diagram illustrating an operation of the bit distributor according to the third embodiment of the present disclosure.

The order of distributing bits to subbands may be determined such that, as illustrating in FIG. 9, on a coordinate plane of the SMF and the normalized value of average subband energy (the value obtained by dividing the average energy of each subband by the maximum average subband energy), that is, on the coordinate plane in which an X coordinate represents SFM and a Y coordinate represents the normalized average subband energy, perpendicular lines are drawn from coordinate points corresponding to the respective subbands to a line of y=x, and the redistribution order is given by an order of positions of the feet of the perpendicular lines from the foot closest to (1.0, 1.0) to the foot farthest therefrom.

Third Setting Method

The first-category subbands subjected to the SBP-AVQ in the first embodiment are all employed as subbands to which bits are redistributed in the descending order of SFM or in the descending order of the average subband energy, or in the order according to the second setting method described above, while $eb_{act}$ is given by the sum of bits distributed to second-category subbands that are not subjected to SBP-AVQ.

In the examples described above, after bits are redistributed by the redistribution calculator 1042, the calculation of bit distribution to the SBP-AVQ vectors is performed by the SBP-AVQ vector distribution calculator 1043. However, the process may be performed in a reverse order. That is, first, the calculation of bit distribution to the SBP-AVQ vectors may be performed by the SBP-AVQ vector distribution calculator 1043, and then the bit redistribution calculation may be performed by the redistribution calculator 1042.

In this case, subbands with energy and/or peak property lower than a predetermined threshold value are selected from the second-category subbands, and bits are redistributed from these selected subbands to the SBP-AVQ vectors.

According to the present embodiment, as described above, it is possible to assign bits for use in the AVQ coding such that bits are assigned preferentially to perceptually important subband vectors or SBP-AVQ vectors, and thus it is possible to achieve a high-quality decoded acoustic signal.

Note that configurations and operations illustrated in block diagrams shown in FIG. 2, FIG. 5, FIG. 6 and FIG. 7 may be realized by dedicatedly designed hardware or may be realized by installing a program in general-purpose hardware and executing the program thereby implementing the methods according to the present disclosure. Examples of general-purpose hardware include a computer such as a personal computer, various kinds of information terminals such as a smartphone, a portable telephone, and the like.

The dedicatedly designed hardware is not limited to a completed product (consumer electronics) such as a portable telephone, a wired telephone, or the like, but a semifinished product or a component such as a system board, a semiconductor device, or the like may be employed as dedicatedly designed hardware.

In the acoustic signal coding apparatus in an aspect the present disclosure, the SBP-AVQ vector generator generates the SBP-AVQ vector by collecting, in addition to the maximum peak, spectral components adjacent to the maximum peak from each first-category subband, outputs the generated SBP-AVQ vector, and outputs peak position information indicating the positions of the maximum peaks.

In the acoustic signal coding apparatus in an aspect of the present disclosure, the SBP-AVQ vector generator generates the SBP-AVQ vector by collecting, in addition to the maximum peak, a next largest peak as a sub-peak from each first-category subband, outputs the generated SBP-AVQ vector, and outputs peak position information indicating the positions of the maximum peaks and the sub-peaks.

The acoustic signal coding apparatus in an aspect of the present disclosure further includes a subband grouper that forms subband groups by groping the subbands, wherein the subband classifier classifies each subband group into a first-category subband and a second-category subband.

The acoustic signal coding apparatus in an aspect of the present disclosure further includes a bit redistributor that redistributes bits distributed by the bit distributor to the vector of the second-category subband, wherein the bit redistributor performs the redistribution such that bits of a second-category subband that is lower than a predetermined threshold value in terms of energy and/or peak property are redistributed to a vector of a first-category subband that is higher than a predetermined threshold value in terms energy and/or peak property.

The acoustic signal coding apparatus in an aspect of the present disclosure further includes a bit redistributor that redistributes bits distributed by the bit distributor to the vector of the second-category subband, wherein the bit redistributor performs the redistribution such that bits of a second-category subband that is lower than a predetermined threshold value in terms of energy and/or peak property are redistributed to an SBP-AVQ vector that is higher than a predetermined threshold value in terms of energy and/or peak property.

In an aspect of the present disclosure, a terminal apparatus includes an antenna that transmits the multiplexed signal output from the acoustic signal coding apparatus.

In an aspect of the present disclosure, a base station apparatus includes the acoustic signal coding apparatus and an antenna that transmits the multiplexed signal output from the acoustic signal coding apparatus.

In an aspect of the present disclosure, a terminal apparatus includes an antenna that receives a multiplexed signal output from the acoustic signal coding apparatus, and an acoustic signal decoding apparatus.

In an aspect of the present disclosure, an acoustic signal coding method includes converting an input signal to a spectrum in a frequency domain, dividing the spectrum in the frequency domain into subbands, classifying the subbands into a plurality of perceptually important first-category subbands and the other subbands as second-category subbands according to energy and/or peak property, generating an SBP-AVQ vector by collecting a maximum peak from each first-category subband, outputting the generated SBP-AVQ vector, and outputting peak position information indicating the positions of the maximum peaks, distributing bits for AVQ coding to the SBP-AVQ vector and the second-category subband, performing AVQ coding using the bits on the SBP-AVQ vector and the second-category subband vector, and outputting a multiplexed signal in which the AVQ-coded signal and the peak position information are multiplexed.

In an aspect of the present disclosure, an acoustic signal decoding method of generating a decoded acoustic signal from the multiplexed signal generated by the acoustic signal coding method includes demultiplexing the multiplexed signal into an AVQ-coded signal and peak position information, AVQ-decoding the AVQ-coded signal thereby generating an SBP-AVQ vector and a second category decoded subband vector, converting the SBP-AVQ vector into a plurality of first category decoded subband vectors using a peak included in the SBP-AVQ vector and the peak position information, and converting the first category decoded subband vector and the second category decoded subband vector into a time-domain signal and outputting the resultant time-domain signal as the decoded acoustic signal.

The acoustic signal coding apparatus and the acoustic signal decoding apparatus according to the present disclosure are applicable to an apparatus associated with recording, transmitting, and/or reproducing an acoustic signal.

What is claimed is:

1. An acoustic signal coding apparatus comprising:

a time-to-frequency converter that converts an input acoustic signal to a spectrum in a frequency domain;

a divider that divides the spectrum in the frequency domain into subbands;

a subband classifier that classifies the subbands into a plurality of perceptually important first-category subbands and the other subbands referred to as second-category subbands according to at least one of measures in terms of energy and peak property;

a subband peak-algebraic vector quantization (SBP-AVQ) vector generator that generates an SBP-AVQ vector by collecting a maximum peak from each first-category subband, outputs the generated SBP-AVQ vector, and outputs peak position information indicating the positions of the maximum peaks;

a bit distributor that distributes bits for AVQ coding to the SBP-AVQ vector and the second-category subband vector;

an AVQ coder that performs AVQ coding using the bits on the SBP-AVQ vector and the second-category subband; and a multiplexer that outputs a multiplexed signal in which the AVQ-coded signal and the peak position information are multiplexed.

2. The acoustic signal coding apparatus according to claim 1, wherein the SBP-AVQ vector generator generates the SBP-AVQ vector by collecting, in addition to the maximum peak, spectral components adjacent to the maximum peak from each first-category subband, outputs the generated SBP-AVQ vector, and outputs peak position information indicating the positions of the maximum peaks.

3. The acoustic signal coding apparatus according to claim 1, wherein the SBP-AVQ vector generator generates the SBP-AVQ vector by collecting, in addition to the maximum peak, a next largest peak as a sub-peak from each first-category subband, outputs the generated SBP-AVQ vector, and outputs peak position information indicating the positions of the maximum peaks and the sub-peaks.

4. The acoustic signal coding apparatus according to claim 1, further comprising:

a subband grouper that forms subband groups by grouping the subbands, wherein the subband classifier classifies each subband group into a first-category subband and a second-category subband.

5. The acoustic signal coding apparatus according to claim 1, further comprising:

a bit redistributor that redistributes bits distributed by the bit distributor to the vector of the second-category subband, wherein the bit redistributor performs the redistribution such that bits of a second-category subband that is lower than a predetermined threshold value in terms of at least one of measures including the energy and the peak property are redistributed to a vector of a first-category subband that is higher than a predetermined threshold value in terms of at least the one of measures.

6. The acoustic signal coding apparatus according to claim 1, further comprising:

a bit redistributor that redistributes bits distributed by the bit distributor to the vector of the second-category subband, wherein the bit redistributor performs the redistribution such that bits of a second-category subband that is lower than a predetermined threshold value in terms of at least one of measures including the energy and the peak property are redistributed to an SBP-AVQ vector that is higher than a predetermined threshold value in terms of at least the one of measures.

7. An acoustic signal decoding apparatus that generates a decoded acoustic signal from the multiplexed signal generated by the acoustic signal coding apparatus according to claim 1, comprising:

a demultiplexer that demultiplexes the multiplexed signal into an AVQ-coded signal and peak position information;

an AVQ decoder that AVQ-decodes the AVQ-coded signal thereby generating an SBP-AVQ vector and a second category decoded subband vector;

a converter that converts the SBP-AVQ vector into a plurality of first category decoded subband vectors using a peak included in the SBP-AVQ vector and the peak position information; and a frequency-to-time converter that converts the first category decoded subband vector and the second category decoded subband vector into a time-domain signal and outputs the resultant time-domain signal as the decoded acoustic signal.

8. A terminal apparatus comprising:

the acoustic signal coding apparatus according to claim 1; and an antenna that transmits the multiplexed signal output from the acoustic signal coding apparatus.

9. A terminal apparatus comprising:

an antenna that receives the multiplexed signal output from the acoustic signal coding apparatus according to claim 1.

10. A base station apparatus comprising:

the acoustic signal coding apparatus according to claim 1; and an antenna that transmits the multiplexed signal output from the acoustic signal coding apparatus.

11. An acoustic signal coding method comprising:

converting an input acoustic signal to a spectrum in a frequency domain;

dividing the spectrum in the frequency domain into subbands;

classifying the subbands into a plurality of perceptually important first-category subbands and the other subbands as a second-category subband according to at least one of measures including energy and peak property;

generating a subband peak-algebraic vector quantization (SBP-AVQ) vector by collecting a maximum peak from each first-category subband, outputting the generated SBP-AVQ vector, and outputting peak position information indicating the positions of the maximum peaks;

distributing bits for AVQ coding to the SBP-AVQ vector and the second-category subband;

performing AVQ coding using the bits on the SBP-AVQ vector and the second-category subband vector; and outputting a multiplexed signal in which the AVQ-coded signal and the peak position information are multiplexed.

12. An acoustic signal decoding method of generating a decoded acoustic signal from the multiplexed signal generated by the acoustic signal coding method according to claim 11, comprising:

demultiplexing the multiplexed signal into an AVQ-coded signal and peak position information;

AVQ-decoding the AVQ-coded signal thereby generating an SBP-AVQ vector and a second category decoded subband vector;

converting the SBP-AVQ vector into a plurality of first category decoded subband vectors using a peak included in the SBP-AVQ vector and the peak position information; and converting the first category decoded subband vector and the second category decoded subband vector into a time-domain signal and outputting the resultant time-domain signal as the decoded acoustic signal.

13. A terminal apparatus comprising:

the acoustic signal decoding apparatus according to claim 7.

* * * * *